US007275804B2

(12) United States Patent
Matsushima

(10) Patent No.: US 7,275,804 B2
(45) Date of Patent: Oct. 2, 2007

(54) INKJET RECORDING APPARATUS

(75) Inventor: Koji Matsushima, Akishima (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 315 days.

(21) Appl. No.: 11/050,047

(22) Filed: Feb. 3, 2005

(65) Prior Publication Data

US 2005/0179725 A1 Aug. 18, 2005

(30) Foreign Application Priority Data

Feb. 12, 2004 (JP) ..... 2004-035190

(51) Int. Cl.
*B41J 2/145* (2006.01)
*B41J 2/15* (2006.01)

(52) U.S. Cl. ..... 347/40; 347/95

(58) Field of Classification Search ..... 347/40, 347/98

See application file for complete search history.

(56) References Cited

U.S. PATENT DOCUMENTS 5,997,132 A * 12/1999 Smith et al. ..... 347/43
6,084,619 A * 7/2000 Takemoto et al. ..... 347/96
6,102,537 A * 8/2000 Kato et al. ..... 347/101
6,467,891 B2 * 10/2002 Moriyama et al. ..... 347/96
6,902,249 B2 * 6/2005 Suzuki et al. ..... 347/15

* cited by examiner

*Primary Examiner*—Thinh Nguyen
(74) *Attorney, Agent, or Firm*—Lucas & Mercanti, LLP

(57) ABSTRACT

An ink jet recording apparatus includes a conveying device for conveying a recording medium to a recording area where ink is jetted, and a plurality of recording heads for jetting ink onto the recording medium, wherein the plurality of recording heads includes a background-color ink recording head for jetting a background-color ink, process-color ink recording heads for jetting process-color inks in respective process colors, and a transparent ink recording head for jetting a transparent ink, and wherein the background-color ink recording head is disposed on a most upstream side in a conveying direction of the recording medium, and the transparent ink recording head is disposed on a most downstream side in the conveying direction of the recording medium.

12 Claims, 6 Drawing Sheets

INKJET RECORDING APPARATUS

FIELD OF THE INVENTION

The present invention relates to an inkjet recording apparatus, and particularly relates to an inkjet recording apparatus which uses transparent ink.

BACKGROUND OF THE INVENTION

To record a color image on resin packing material or the like, image recording is mainly performed by gravure printing in which ink is put into recessed portions formed on a printing surface and directly transferred to a recording medium. Gravure printing has features that allow it to colorfully express characters, symbols, pictures, for example, and perform fast recording on recording media in a large amount. Herein, for example, in case of recording an image on a transparent packing material, recording is sometimes performed on a back side of the packing material to maintain durability against rubbing of the recording surface, which is called 'back-printing'. On the other hand, in case of recording an image on an opaque packing material, the recording is performed on the front side of the packing material, which is called 'front-printing'.

In case of recording characters, symbols, or pictures on a packing material, with a background color in a special color such as white, gravure printing is a useful recording technology having the above features. However, in gravure printing, it is necessary to prepare a plate in a pre-process prior to actual image recording, and an extra cost and time are consumed to prepare this plate.

In this situation, attention is paid to recording technologies which use an inkjet recording apparatus without requiring a pre-process. As an inkjet recording apparatus capable of recording characters, symbols, or pictures with process-color inks together with a background color in a special color such as white on a transparent or translucent resin packing material, there have been developed inkjet recording apparatuses having a control device to make it possible to selectively perform front-printing and back-printing (as an example, see Patent Document 1).

Further, as inkjet recording apparatuses applicable to various recording media, inkjet recording apparatuses which use photo-curable ink are known. In such an inkjet recording apparatus, light is emitted to ink having landed on a recording medium, and thus, the ink is instantly cured, by which the ink sinks or bleeds into the recording medium little. Therefore, it is possible to perform image recording, not only on a plain paper sheet, but also on a recording medium having no image receiving layer or ink absorbance, such as a plastic or metal recording medium.

In general, in case of performing image recording by the use of a recording medium having an image receiving layer, most ink is absorbed by the recording medium. However, in case of performing image recording by the use of photo-curable ink and a recording medium having no image receiving layer, ink is cured and fixed simultaneously as light is irradiated to the ink, without being absorbed by the recording medium. Therefore, the ink remains on the surface of the recording medium in a state that the portions where ink landed are raised with cured ink.

As in this case where cured layers without flatness are present on a recording medium surface, namely in an image, uneven gloss is visually recognized, and thus image quality as a whole image is degraded, causing a problem that precise image recording can not be achieved.

In this situation, in order to reduce the difference in feeling of gloss between image portions and non-image portions, inkjet printing apparatuses have been developed which properly adjust the composition of a transparent ink which is not colored at all or virtually not colored, and jet this transparent ink onto non-image portions on a recording medium to smooth the surface of the recording medium (for example, see Patent Document 2).

[Patent Document 1] TOKKAI No. 2003-285427

[Patent Document 2] TOKKAI No. 2003-191601

However, in case of performing front-side printing by an inkjet recording apparatus using UV curable ink, process-color ink is jetted after special color ink such as white ink as the background color is jetted onto a packing material of a transparent or opaque resin. Herein, ink is cured and fixed simultaneously as light is irradiated to the ink and is not absorbed by the recording medium. Thus, image grainy or roughness of image surface significantly appears to create an excessive feeling of gloss, causing a problem of deterioration in quality of printed characters and images, compared with a case of back-printing in which process-color ink is jetted and then background-color ink such as white ink is jetted.

An inkjet recording apparatus has not yet been developed which can record characters, symbols, pictures, and the like in process colors with a background in a special color such as white, and can create a uniform feeling of gloss with transparent ink on a recording medium having no image receiving layer.

SUMMARY OF THE INVENTION

With the above background, the present invention has been devised and has an object to provide an inkjet recording apparatus that prevents an excessive feeling of gloss due to image grainy or surface roughness generated during image recording on a packing material of transparent or opaque resin.

In a first aspect of the invention, an ink jet recording apparatus includes a plurality of recording heads for jetting ink onto a recording medium, and a conveying device for conveying the recording medium to a recording area where ink is jetted. Herein, the plurality of recording heads includes a background-color ink recording head for jetting a background-color ink, process-color ink recording heads for jetting process-color inks in respective process colors, and a transparent ink recording head for jetting a transparent ink, wherein the background-color ink recording head is disposed on a most upstream side in a conveying direction of the recording medium, and the transparent ink recording head is disposed on a most downstream side in the conveying direction of the recording medium.

According to the first aspect of the invention, ink is jetted from the background-color ink recording head, then, ink can be jetted from one or more process-color ink recording heads of the respective process-color ink recording heads, and thereafter ink is jetted from the transparent ink recording head.

Thus, the background-color ink having been firstly jetted prevents transmission of light.

Further, the transparent ink jetted last makes the amount of ink on the recording medium uniform to prevent generation of roughness of the surface formed on the recording medium.

Another object of the invention is to provide an inkjet recording apparatus in accordance with the first aspect of the invention, with a reduced number of recording heads and with a reduced size of the apparatus.

In a second aspect of the invention, in the inkjet recording apparatus in accordance with the first aspect, the inks to be jetted from the respective recording heads, the heads being the background-color ink recording head/heads, the process-color ink recording heads, and the transparent ink recording head/heads, are jetted as ink droplets. Herein, a jetting amount per droplet of the ink jetted from at least either the background-color ink recording head or the transparent ink recording head is larger than a jetting amount per droplet of the ink jetted from each of the process-color ink recording heads.

According to the second aspect of the invention, it is possible to perform image recording by an apparatus with a background-color ink recording head/heads and a transparent ink recording head/heads reduced to half in quantity or in size. Thus, it is possible to miniaturize the inkjet recording apparatus and reduce the manufacturing cost.

DETAILED DESCRIPTION OF THE PREFERRED EMBODIMENTS

Figure 1:
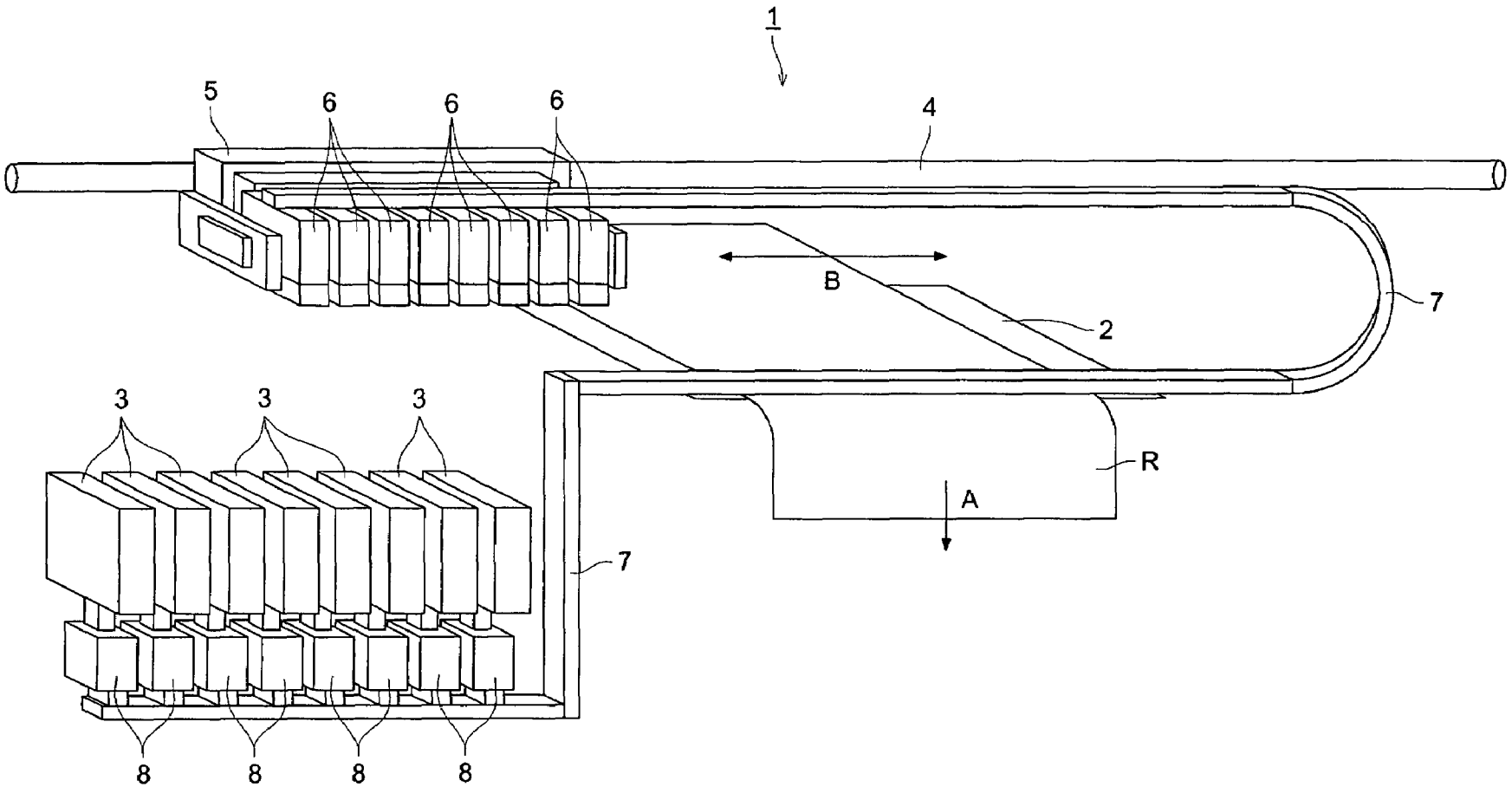
FIG. 1 is a schematic diagram showing a main part of an inkjet recording apparatuses in first and second embodiments.

The invention includes the following structures.

(1) An inkjet recording apparatus has a plurality of recording heads for jetting ink onto a recording medium, wherein the plurality of recording heads includes a background-color ink recording head for jetting a background-color ink, process-color ink recording heads for jetting inks in respective process colors, and a transparent ink recording head for jetting a transparent ink. Herein, the background-color ink recording head is disposed on the most upstream side in the conveying direction of the recording medium, and the transparent ink recording head is disposed on the most downstream side in the conveying direction of the recording medium. Herein, the most upstream side means the front-end side of a series of disposed recording heads in terms of the relative motion of the series of recording heads to the recording medium.

According to the above item (1), ink is jetted from the background-color ink recording head, then, ink is jetted from at least one process-color ink recording head of the respective process-color ink recording heads, and thereafter ink is jetted from the transparent ink recording head.

Thus, the background-color ink having been firstly jetted prevents transmission of light.

Further, the transparent ink jetted last makes the amount of ink on the recording medium uniform to prevent generation of roughness of the surface formed on the recording medium. Thus, it is possible to record a highly precise image with a uniform feeling of gloss without performing a special post-processing.

(2) The inkjet recording apparatus of item (1) has a carriage that scans in a direction orthogonal to the conveying direction of the recording medium, wherein the background-color ink recording head, the respective process-color ink recording heads, and the transparent ink recording head are mounted on the carriage.

According to item (2), the background-color ink recording head, the respective process-color ink recording heads, and the transparent ink recording head are mounted on a single carriage. Thus, with a simple structure with consideration of disposition of the respective recording heads on the carriage, transmission of light can be prevented by the background-color ink, and the surface formed on the recording medium can be prevented by the transparent ink from becoming rough. With the simple structure, it is also possible to miniaturize the inkjet recording apparatus 1 and reduce the manufacturing cost.

(3) In the inkjet recording apparatus of item (1), the background-color ink recording head, the respective process-color ink recording heads, and the transparent ink recording head are line-heads disposed orthogonally to the conveying direction of the recording medium.

Thus, according to item (3), with a simple structure with consideration of disposition of the respective line-heads, transmission of light can be prevented by the background-color ink, and generation of roughness on the surface of the recording medium can also be prevented by the transparent ink. With the simple structure, it is also possible to miniaturize the inkjet recording apparatus and reduce the manufacturing cost.

(4) In the inkjet recording apparatus of any one of items (1) to (3), the inks to be jetted from the respective recording heads including the background-color ink recording head, the process-color ink recording heads, and the transparent ink recording head are jetted in ink droplets, wherein the jetting amount per droplet of the ink jetted from at least either the background-color ink recording head or the transparent ink recording head is larger than the jetting amount per droplet of the ink jetted from each process-color ink recording head.

According to item (4), each jetting amount per droplet of ink jetted from the background-color ink recording head and/or the transparent ink recording head is larger than the jetting amount per droplet of ink jetted from each process-color ink recording head. Therefore, when a single droplet of ink is jetted from each recording head on to the recording medium, the areas occupied by the ink droplet from the background-color ink recording head and/or the area occupied by the ink droplet from the transparent ink recording head is larger than each of the areas occupied by ink droplets from the respective process-color ink recording heads, which makes it possible to reduce the number of background-color ink recording heads and the transparent ink recording heads or miniaturize them.

(5) For the inkjet recording apparatus of any one of items (1) to (4), the background-color ink, the respective process-color inks, and the transparent ink, are UV-curable inks, which are cured by irradiation of UV-light.

Thus, according to item (5), ink can be efficiently cured by irradiation of UV-light. Thus, it is possible to record a highly precise image even on a recording medium with low ink absorbance such as a resin film.

(6) For the inkjet recording apparatus of any one of items (1) to (5), the recording medium on which to record an image with the background-color ink, the respective process-color inks, and the transparent ink, is a transparent or translucent resin film.

According to item (6), since the recording medium on which to record an image is a transparent or translucent resin film, high viscous inks are used to prevent flowing of inks on the recording medium. Even in this case, the amount of ink on the recording medium is made uniform by jetted transparent ink to prevent making the surface formed on the recording medium rough. Thus, it is possible to record a highly precise image with a uniform feeling of gloss without performing a special post-processing.

Preferred embodiments in accordance with the invention will be described below, referring to the drawings. In the embodiments described below, various limitations are considered which are technically preferable in practicing the invention. However, the scope of the invention is not limited to the following embodiments or shown examples.

Referring to FIGS. 1 to 5, an inkjet recording apparatus in accordance with the invention will be described.

As shown in FIG. 1, regarding an inkjet recording apparatus 1 in accordance with the invention, each component is covered by a housing, not shown, in which is provided a flat-formed platen 2 that supports a recording medium P from the non-recording surface side. On the upstream side and the downstream side of the platen 2, conveying rollers (not shown) for conveying the recording medium P are disposed. These conveying rollers are rotated so that the recording medium P is conveyed from the upstream side to the downstream side with its non-recording surface supported by the platen 2. Herein, the conveying direction of the recording medium P is defined as sub scanning direction A.

A plurality of ink tanks 3 corresponding to respective colors are disposed on one side below the platen 2 along the direction orthogonal to the sub scanning direction A. The respective ink tanks 3 are replaceable and store inks in the respective colors.

A long guide rail 4 is disposed above the platen 2, extending in the direction orthogonal to the sub scanning direction A. Herein, the direction in which the guide rail 4 extends is defined as main scanning direction B. The guide rail 4 supports a carriage 5 which is reciprocably movable in main scanning direction B, guided by the guide rail 4.

A plurality of recording heads 6, 6, . . . for jetting ink onto the recording medium P are mounted on the carriage 5. Each recording head 6 and ink tank 3 in a corresponding relationship with each other in terms of ink type are connected to each other through an ink supply tube 7 formed by a tube-shaped material having flexibility such as rubber. In such a manner, it possible to supply inks in the respective colors from the respective ink tanks 3 to the respective recording heads 6.

Supply tubes 7 are provided with respective variable pressure pumps 8 for supplying ink from the respective ink tanks 3 to the respective recording heads 6. The respective variable pressure pumps 8 can vary the inner pressure of the ink tubes 7, and thereby ink supply amounts from the respective ink tanks 3 to the respective recording heads 6 can be properly varied.

Figure 2:
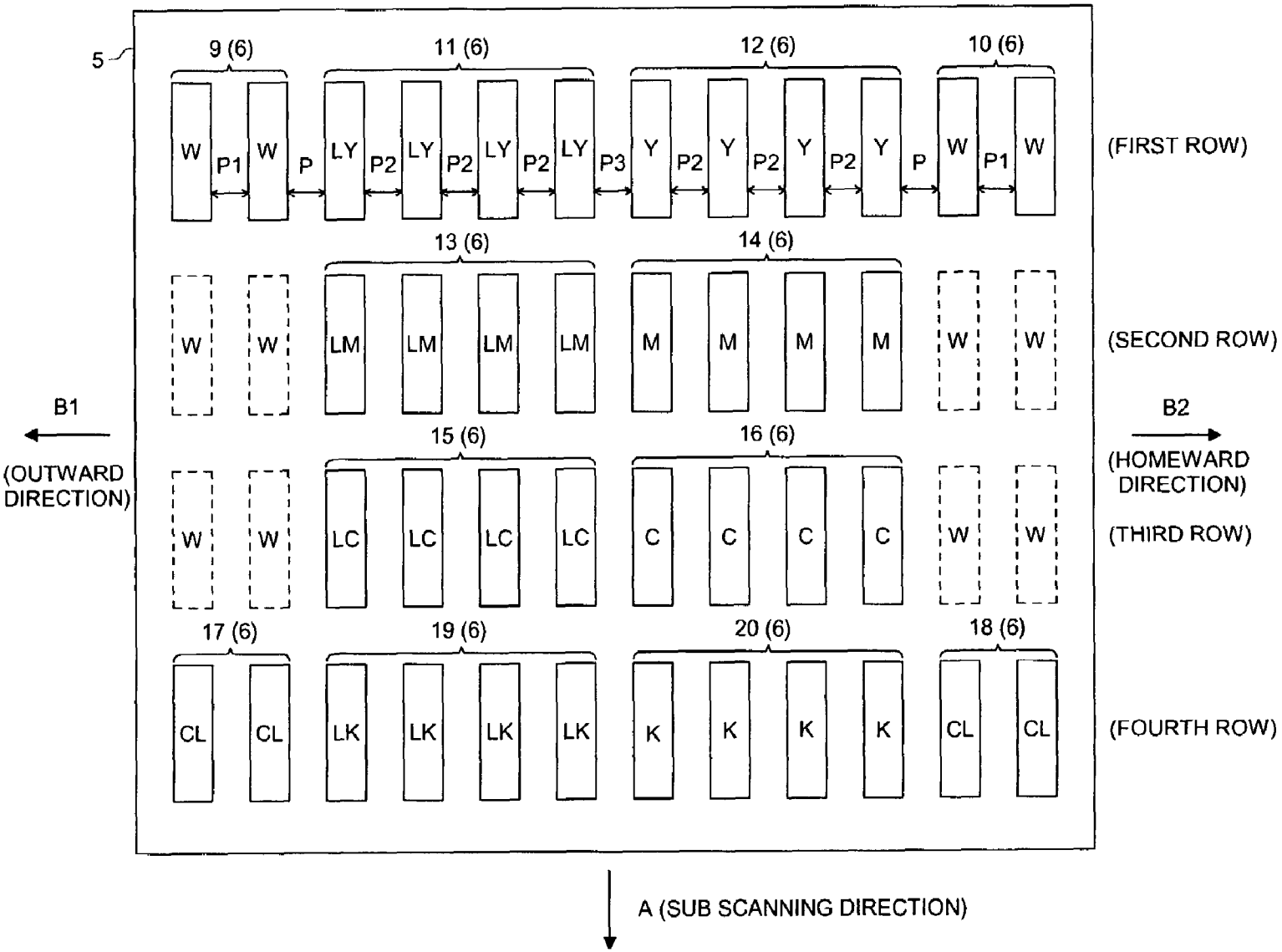
FIG. 2 is a plane view showing a disposition relationship between groups of white ink recording heads, groups of respective process-color ink recording heads, and groups of transparent ink recording heads in the first embodiment.

As the plurality of recording heads 6, 6, . . . mounted on the carriage 5, as shown in FIG. 2, there are disposed 2 units of first white ink recording heads 9 and 2 units of second white ink recording heads 10 at the respective ends of the carriage 5 on the most upstream side (hereinafter, this row of recording heads being referred to as a first row) in sub scanning direction A. Between the recording heads 9 and the recording heads 10, there are disposed four light-yellow ink recording heads 11 and four yellow ink recording heads 12 along main scanning direction B.

Further, on a downstream side of the light-yellow ink recording heads 11 and the yellow ink recording heads 12 in the sub scanning direction A, four light-magenta ink recording heads 13 and four magenta ink recording heads 14 are disposed along the main scanning direction B (hereinafter, the row of the these recording heads being referred to as a second row). On a further downstream side of them, four light-cyan ink recording heads 15 and four cyan ink recording heads 16 are disposed along the main scanning direction B (hereinafter, the row of these recording heads being referred to as a third row).

On the downstream side of the light-cyan ink recording heads 15 and the cyan ink recording heads 16 in the sub scanning direction A, namely, the most downstream side of the carriage 5 in the sub scanning direction A, 2 units of first transparent ink recording heads 17 and 2 units of second transparent ink recording heads 18 are disposed at the respective ends of the carriage 5 (hereinafter, the row of these recording heads being referred to as a fourth row). Herein, the most downstream side means the rear-end side of a series of recording heads in terms of the relative motion of the series of recording heads to the recording medium. Between the first transparent ink recording heads 17 and the second transparent ink recording heads 18, there are disposed four light-black ink recording heads and four black ink recording heads 20 along the main scanning direction B.

Herein, denoting the distance between the first white ink recording heads 9 and the distance between the second white ink recording heads 10 by pitch P1, the distance between the light-yellow ink recording heads 11 and the distance between the yellow ink recording heads 12 by pitch P2, the distance between the neighboring light-yellow ink recording head 11 and the yellow ink recording head 12 by P3, and the distance between the neighboring white ink recording head 9 and the light-yellow ink recording head 11 and the distance between the neighboring white ink recording head 10 and the yellow ink recording head 12 by pitch P, the pitches P, P1, P2, and P3 are approximately the same along the main scanning direction B as shown in FIG. 2.

The recording heads 6 are formed in an approximately rectangular parallelepiped shape and disposed such that the longitudinal direction of the recording heads 6 is parallel to the sub scanning direction A. Each recording head 6 has a jetting surface at the bottom surface where a plurality of nozzles (not shown) for jetting ink is disposed on a line in the longitudinal direction.

The nozzles disposed on the respective recording heads 6 jet ink to be jetted as ink droplets, wherein the jetting amounts per droplet of ink jetted from the white ink recording heads 9, 10 and the transparent ink recording heads 17, 18 are designed to be larger than the jetting amount per droplet of ink jetted from the respective process-color ink recording heads 11, 12, 13, 14, 15, 16, 19, 20.

The white ink, respective process-color inks, and transparent ink in the present embodiment are UV-curable inks, wherein water-based ink, oil-based ink, solvent ink, and solid ink are all applicable. As colorant to be used for water-based ink and oil-based ink, pigments or dyes are applicable.

The process-color inks in the present embodiment are standard inks in four colors of yellow (Y), magenta (M), cyan (C), and black (K), and light-color inks in four colors of light-yellow (LY), light-magenta (LM), light-cyan (LC), and light-black (LK), namely color inks in total eight colors. In the present embodiment, inks in eight colors are employed as process-color ink. However, it is not always necessary to use inks in eight colors as process-color ink, and it is also allowed if at least one color of eight colors is used as process-color ink.

The recording medium R in the present embodiment is, for example, a transparent or a translucent resin film, wherein PET (polyethylene terephthalate), PS (polystyrene), and PP (Polypropylene), for example, are preferable as a resin.

Next, operation and function in accordance with the present embodiment will be described.

When image information has been transmitted to the inkjet recording apparatus 1, the recording medium R is intermittedly conveyed in the sub scanning direction A on the platen 2 in a state where the platen 2 supports the non-recording surface of the recording medium R, and the carriage 5 having waited at an initial position moves along an outward direction B1.

Herein, the recording heads 6, 6, . . . disposed in the first row pass above a recording area in the order of the first white ink recording heads 9, the light-yellow ink recording heads 11, yellow ink recording heads 12, and the second white ink recording heads 10, while ink is jetted from the first white ink recording heads 9, the light-yellow ink recording heads 11, and the yellow ink recording heads 12. Herein, ink is not jetted from the second white ink recording heads 10.

Then, when the carriage 5 having moved along the outward direction B1 has reached the end position in the outward direction B1, the carriage 5 returns to the initial position.

During the above process, the recording medium R is in a stopped state.

Then, the recording medium R moves a predetermined distance along the sub scanning direction A and stops. In such a way, a series of operations as described above is repeated for an appropriate number of times.

Further, the recording heads 6, 6, . . . disposed in the second row pass above the aforementioned recording area in the order of the light-magenta ink recording heads 13 and then the magenta ink recording heads 14, while ink is jetted from the light-magenta ink recording heads 13 and the magenta ink recording heads 14. In such a way, a series of operations including motion of a predetermined distance and stop of the recording medium R, and reciprocal motion of the carriage 5 in the outward direction B1 and the homeward direction B2 is repeated for an appropriate number of times.

Still further, the recording heads 6, 6, . . . disposed in the third row pass above the recording area in the order of the light-cyan ink recording heads 15 and then the cyan ink recording heads 16, while ink is jetted from the light-cyan ink recording heads 15 and the cyan ink recording heads 16. In such a way, a series of operations including motion of the predetermined distance and stop of the recording medium R, and reciprocal motion of the carriage 5 in the outward direction B1 and the homeward direction B2 is repeated for an appropriate number of times.

Yet further, the recording heads 6, 6, . . . disposed in the fourth row pass above the recording area in the order of the first transparent ink recording heads 17, the light-black ink recording heads 19, the black ink recording heads 20, and the second transparent ink recording heads 18, while ink is jetted from the light-black ink recording heads 19, the black ink recording heads 20, and the second transparent ink recording heads 18. Herein, ink is not jetted from the first transparent ink recording heads 17.

Then, a series of operations including the motion of the predetermined distance and stop of the recording medium R, and the reciprocal motion of the carriage 5 in the outward direction B1 and the homeward direction B2 is repeated for an appropriate number of times, and thus image recording on the recording area is completed.

Apart from the above, image recording can also be performed in operations different from those described above, controlled by a controller, not shown. These recording operations will be described below in detail.

When image information has been transmitted to the inkjet recording apparatus 1, the recording medium R is intermittedly conveyed in the sub scanning direction A on the platen 2 in a state where the platen 2 supports the non-recording surface of the recording medium R, and the carriage 5 having waited at the initial position moves along the outward direction B1.

Herein, the recording heads 6, 6, . . . disposed in the first row pass above the recording area in the order of the first white ink recording heads 9, the light-yellow ink recording heads 11, the yellow ink recording heads 12, and the second white ink recording heads 10, while ink is jetted from the first white ink recording heads 9, the light-yellow ink recording heads 11, and the yellow ink recording heads 12. Herein, ink is not jetted from the second white ink recording heads 10.

Then, the carriage 5 having moved along the outward direction B1 reaches the end position in the outward direction B1, and the recording medium R moves a predetermined distance along the sub scanning direction A and stops.

Next, the carriage 5 having reached the end position (the initial position in the homeward direction B2) in the outward direction B1 moves along the homeward direction B2.

Herein, the recording heads 6, 6, . . . disposed in the first row pass above the recording area in the order of the second white ink recording heads 10, the yellow ink recording heads 12, the light-yellow ink recording heads 11, and the first white ink recording heads 9, while ink is jetted from the second white ink recording heads 10, the yellow ink recording heads 12, and the light-yellow ink recording heads 11. Herein, ink is not jetted from the first white ink recording heads 9.

Then, when the carriage 5 having moved along the homeward direction B2 reaches the end position in the homeward direction B2 (that is the initial position in the outward direction B1).

Then, the recording medium R moves a predetermined distance along the sub scanning direction A and stops. In such a way, a series of operations as described above is repeated for an appropriate number of times.

Further, also thereafter, recording heads 13 to 20 disposed in the second to fourth rows pass above the recording area, while ink is jetted from these recording heads 13 to 20. A series of these operations including the motion of the predetermined distance and stop of the recording medium R and the reciprocal motion of the carriage 5 in the outward direction B1 and the homeward direction B2 is repeated an appropriate number of times.

When the above described series of operations has been performed the appropriate number of times, image recording on the recording area is completed.

As stated above, the inkjet recording apparatus in accordance with the present invention jets ink from the first white ink recording heads 9, then from at least one process-color ink recording head of the process-color ink recording heads 11, 12, 13, 14, 15, 16, 19, and 20, and thereafter from the transparent ink recording heads 18.

Thus, white ink jetted first can prevent transmission of light, by which it is possible to make the image stand out clearly and perform image recording on the transparent or translucent recording medium R.

Further, the transparent ink jetted last makes the amount of ink on the surface of the recording medium uniform to prevent making the surface formed on the recording medium rough, by which it is possible to record a highly precise image with a uniform feeling of gloss without performing a special post-processing.

Further, the white ink recording heads 9, 10, the respective process-color ink recording heads 11, 12, 13, 14, 15, 16, 19, 20, and the transparent ink recording head 17, 18 are mounted on a single carriage. Therefore, with a simple structure with consideration of disposition of the respective recording heads on the carriage, the background-color ink can prevent transmission of light, and the transparent ink can prevent the surface formed on the recording medium from becoming rough. With the simple structure, it is also possible to miniaturize the inkjet recording apparatus 1 and reduce the manufacturing cost.

Still further, herein, white ink is often recorded on the entire surface of the recording medium as a background-color. Accordingly, the jetting amount per droplet of the white ink may be set larger. Likewise, transparent ink is often recorded on the entire surface of the recording medium, and the jetting amount per droplet of the transparent ink may be set larger.

Specifically, the jetting amount per droplet of ink jetted from the white ink recording heads 9, 10 and the jetting amount per droplet of ink jetted from transparent ink recording heads 17, 18 are larger than the jetting amount per droplet of each ink jetted from the process-color ink recording heads 11, 12, 13, 14, 15, 16, 19, 20. Therefore, when a single droplet of ink is jetted from each recording head 6 on to the recording medium, the area on the recording medium R occupied by ink droplet from any of the white ink recording heads 9, 10 and the transparent ink recording heads 17, 18 is larger than the area occupied by ink droplet from any of the respective process-color ink recording heads 11, 12, 13, 14, 15, 16, 19, 20, which makes it possible to reduce the number of white ink recording heads 9, 10 and the transparent ink recording heads 17, 18, or to miniaturize them. By setting the jetting amount per droplet of ink jetted from each of the white ink recording heads and that from each of the transparent ink recording heads in such a manner, the number of these recording heads can be reduced, or these recording heads can be miniaturized. Thus, it is possible to miniaturize an inkjet recording apparatus and reduce the manufacturing cost.

For example, by setting the jetting amount per ink droplet to be twice as large, the quantity of nozzles can be reduced to half. Therefore, it is possible to perform image recording by an apparatus with the number of background-color ink recording heads and the number of transparent ink recording heads reduced to half or with the sizes of these recording heads reduced to half.

Yet further, since the white ink, the respective process-color inks, and the transparent ink are UV-curable inks, ink can be efficiently cured by UV-light irradiation. Thus, it is possible to record a highly precise image even on a recording medium with low ink absorbance such as a resin film.

Further, since the recording medium R on which to record an image is a transparent or translucent resin film, high viscous inks are used to prevent flowing of inks on the surface of the recording medium R. Even in this situation, the amount of ink on the surface of the recording medium is made uniform by jetted transparent ink to prevent making the surface formed on the recording medium rough.

Next, a second embodiment will be described, referring to FIG. 3. The present embodiment is different from the first embodiment only in disposition of recording heads 6, while inks, the recording medium, and others are the same as those in the first embodiment. Therefore, in the present embodiment, disposition of recording heads 6 will be mainly described, and elements similar to those in the first embodiment are given the same symbols, omitting detail description of them.

Figure 3:
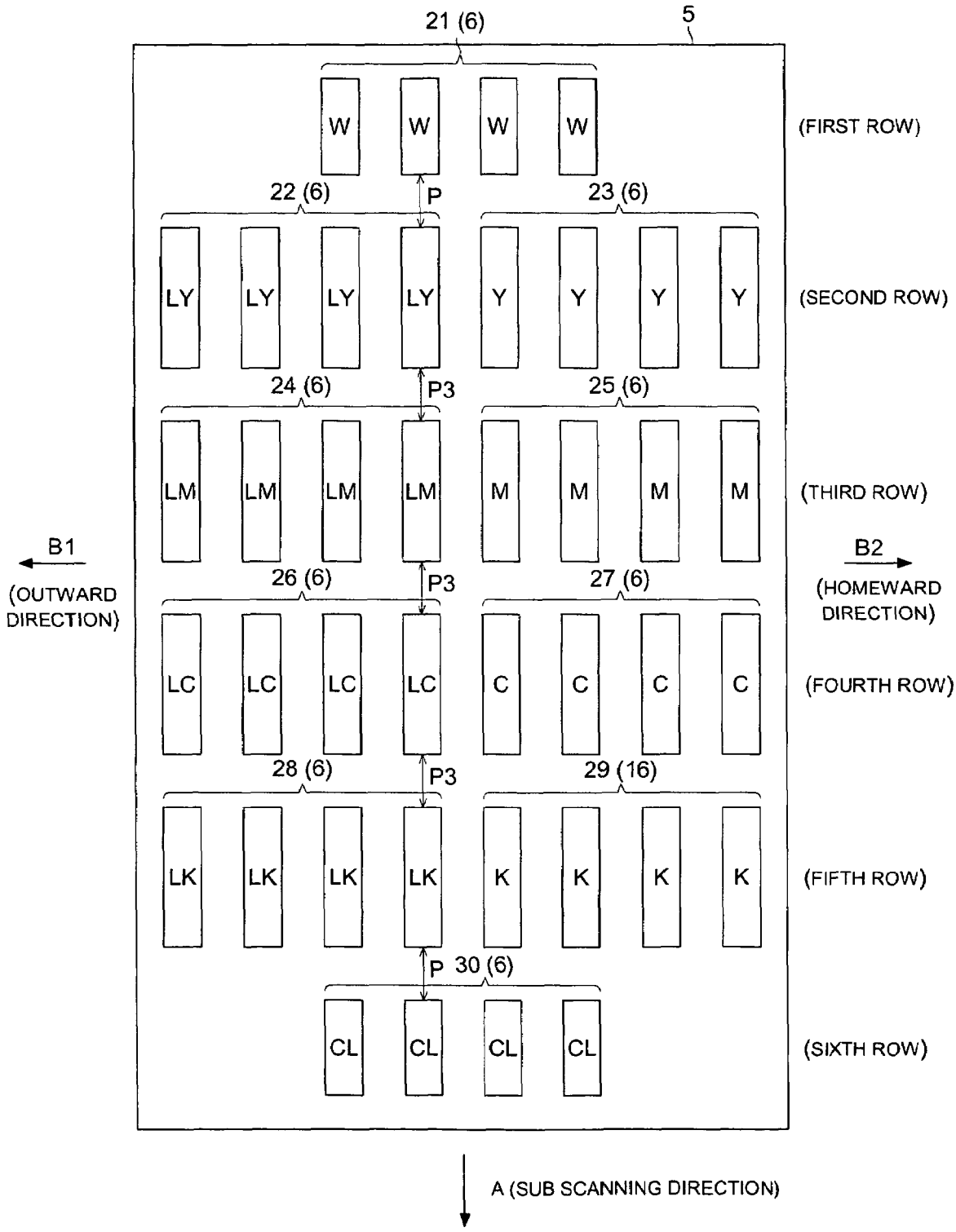
FIG. 3 is a plane view showing a disposition relationship between groups of white ink recording heads, groups of respective process-color ink recording heads, and groups of transparent ink recording heads in the second embodiment.

As shown in FIG. 3, a plurality of recording heads 6, 6, . . . are mounted on a carriage 5, wherein four white ink recording heads 21 (hereinafter, the row of these recording heads being referred to as a first row) are disposed on the most upstream side in a sub scanning direction A. On the downstream side of them, four light-yellow ink recording heads 22 and four yellow ink recording heads 23 (hereinafter, these recording heads being referred to as a second row) are disposed along a main scanning direction B. Herein, in terms of disposition in the main scanning direction B, the four white ink recording heads 21 in the first row are disposed at an approximately center position corresponding to the four recording heads, disposed in the center, of the total eight recording heads that are four light-yellow ink recording heads 22 and the four yellow ink recording heads 23 in the second row.

On the downstream side of the light-yellow ink recording heads 22 and the yellow ink recording heads 23 in the sub scanning direction A, four light-magenta ink recording heads 24 and four magenta ink recording heads 25 (hereinafter, these recording heads being referred to as a third row) are disposed along the main scanning direction B. On the downstream side of them, four light-cyan ink recording heads 26 and four cyan ink recording heads 27 (hereinafter, these recording heads being referred to as a fourth row) are disposed along the main scanning direction B. On the downstream side of them, four light-black ink recording heads 28 and four black ink recording heads 29 (hereinafter, these recording heads being referred to as a fifth row) are disposed along the main scanning direction B.

Still further, on the downstream side of the light-black ink recording heads 28 and the black ink recording heads 29 in the sub scanning direction A, namely, the most downstream side of the carriage 5 in the sub scanning direction A, four transparent ink recording heads 30 are disposed (hereinafter, these recording heads being referred to as a sixth row). Herein, in terms of disposition in the main scanning direction B, the four transparent ink recording heads 30 in the sixth row are disposed at an approximately center position corresponding to the four recording heads, disposed in the center, of the total eight recording heads that are four light-black ink recording heads 28 and the four black ink recording heads 29 in the fifth row.

Herein, pitch P3 denotes the distance between the neighboring light-yellow ink recording heads 22, light-magenta ink recording heads 24, light-cyan ink recording heads 26, and the light-black ink recording heads 28, and pitch P denotes the distance between the neighboring white ink recording heads 21 and the light-yellow ink recording heads 22 and the distance between the neighboring transparent ink recording heads 30 and the light-black ink recording heads 28. Then, pitches P and P3 are approximately the same along the sub scanning direction A, as shown in FIG. 3.

The respective recording heads 6 are formed in an approximately rectangular parallelepiped shape, wherein the white ink recording heads and the transparent ink recording heads are shorter in the longitudinal direction than the respective process-color ink recording heads. The respective recording heads are disposed such that the longitudinal direction of the recording heads 6 is parallel to the sub scanning direction A. Each recording head 6 has a jetting surface at the bottom surface where a plurality of nozzles (not shown) for jetting ink is disposed on a line in the longitudinal direction.

Next, operation and function in accordance with the present embodiment will be described.

When image information has been transmitted to the inkjet recording apparatus 1, the recording medium R is intermittedly conveyed in the sub scanning direction A on the platen 2 in a state where the platen 2 supports the non-recording surface of the recording medium R, and the carriage 5 having waited at an initial position moves along an outward direction B1.

Herein, the white ink recording heads 21 disposed in the first row pass above a recording area, while jetting ink.

Then, the carriage 5 having moved along the outward direction B1 reaches the end position in the outward direction B1 and then returns to the initial position.

During the above process, the recording medium R is in a stopped state.

Further, the recording medium R moves a predetermined distance in the sub scanning direction A and stops. Such a series of operations as described above is repeated for an appropriate number of times.

Further, following the white recording heads 21, recording heads 22 to 30 disposed in the second to sixth rows pass above the recording area, while ink is jetted from these recording heads 22 to 30. Such a series of operations including the motion of the predetermined distance and stop of the recording medium R and the reciprocal motion of the carriage 5 in the outward direction B1 and the homeward direction B2 is repeated an appropriate number of times. When the repeat of the above described series of operations has been performed, image recording on the recording area is completed.

Apart from the above, image recording can also be performed in operations different from those described above, controlled by a controller, not shown. These recording operations will be described below.

When image information has been transmitted to the inkjet recording apparatus 1, the recording medium R is intermittedly conveyed in the sub scanning direction A on the platen 2 in a state where the platen 2 supports the non-recording surface of the recording medium R, and the carriage 5 having waited at an initial position moves along an outward direction B1.

Herein, the white ink recording heads 21 disposed in the first row pass above the recording area, while jetting white ink there.

Then, the carriage 5 having moved along the outward direction B1 reaches the end position in the outward direction B1, and the recording medium R moves a predetermined distance along the sub scanning direction A and stops.

Next, the carriage 5 having reached the end position (the initial position in the homeward direction B2) in the outward direction B1 moves along the homeward direction B2.

Herein, the white ink recording heads 21 disposed in the first row pass above the recording area, while jetting ink there.

Thereafter, the carriage 5 having moved in the homeward direction B2 reaches the end position (the initial position in the outward direction B1) in the homeward direction B2. Then, the recording medium R moves the predetermined amount in the sub scanning direction A and stops. A series of the above described operations are repeated an appropriate number of times.

Further, following the white ink recording heads 21, recording heads 22 to 30 disposed in the second to sixth rows pass above the recording area, while jetting ink there. Such a series of operations including the motion of the predetermined distance and stop of the recording medium R and the reciprocal motion of the carriage 5 in the outward direction B1 and the homeward direction B2 is repeated an appropriate number of times.

When the repeat of the above described series of operations has been performed, image recording on the recording area is completed.

As stated above, the inkjet recording apparatus in accordance with the present invention jets ink from the white ink recording heads 21, then from at least one process-color ink recording head of the process-color ink recording heads 22, 23, 24, 25, 26, 27, 28, and 29, and thereafter from the transparent ink recording heads 30.

Thus, it is possible to prevent transmission of light by white ink jetted first, by which it is possible to make the image stand out clearly and perform image recording on the transparent or translucent recording medium R.

Further, the transparent ink jetted last makes the amount of ink on the surface of the recording medium uniform to prevent making the surface formed on the recording medium rough, by which it is possible to record a highly precise image with a uniform feeling of gloss without performing a special post-processing.

Further, the white ink recording heads 21, the respective process-color ink recording heads 22, 23, 24, 25, 26, 27, 28, 29 and the transparent ink recording heads 30 are mounted on a single carriage. Therefore, with a simple structure with consideration of disposition of the respective recording heads on the carriage, the white ink can prevent transmission of light, and the transparent ink can prevent the surface of the recording medium from becoming rough, by which it is possible to miniaturize the inkjet recording apparatus and reduce the manufacturing cost.

Next, a third embodiment will be described below, referring to FIG. 4. The present embodiment is different from the first embodiment in disposition of recording heads 6, while the inks, the recording medium, and others are the same as those in the first embodiment. Therefore, in the present embodiment, disposition of recording heads 6 will be mainly described, and elements similar to those in the first embodiment are given the same symbols, omitting detail description of them.

Figure 4:
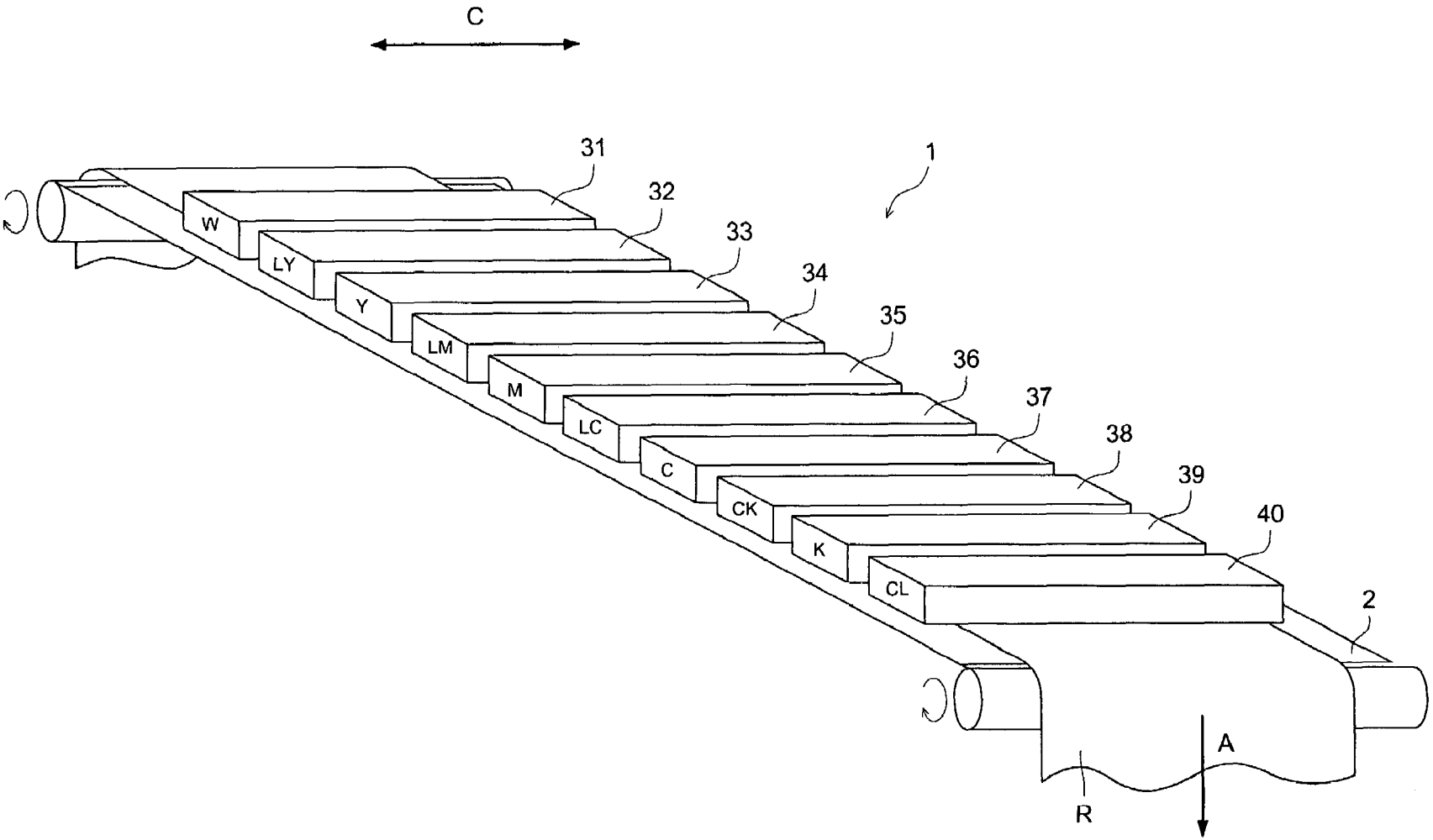
FIG. 4 is a schematic diagram showing a main part of an inkjet recording apparatus in a third embodiment.

As shown in FIG. 4, an inkjet recording apparatus 1 in the present embodiment is provided with a platen 2. Above the platen 2 and from upstream to downstream in a sub scanning direction A, there are disposed a white ink line-head 31, a light-yellow ink line-head 32, a yellow ink line-head 33, a light-magenta ink line-head 34, a magenta ink line-head 35, a light-cyan ink line-head 36, a cyan ink line-head 37, a light-black ink line-head 38, a black ink line-head 39, and a transparent ink line-head 40.

Each line-head extends approximately over the entire width of a recording medium R, orthogonally to the conveying direction of the recording medium R. Each line-head has a jetting surface at the bottom surface where a plurality of nozzles (not shown) for jetting ink, as ink droplets, is disposed. Herein, the extending direction of each line-head is denoted as extension direction C.

Next, operation and function of the present embodiment will be described below.

When image information has been transmitted to the inkjet recording apparatus 1, conveying rollers rotate to continuously convey a recording medium R in a sub scanning direction A on a platen 2 in a state where the non-recording surface is supported by the platen 2.

Herein, the recording medium R passes under a white ink line-head 31 disposed on the most upstream side in the sub scanning direction A, while the white ink line-head 31 jets white ink onto a recording area.

Then, the recording medium R passes under the respective process-color ink line-heads 32 to 39 disposed on the downstream side of the white ink line-head 31 in the sub scanning direction A, while ink is jetted from these process-color ink line-heads on the recording area.

Further, the recording medium R passes under a transparent ink line-head 40, disposed on the most downstream side in the sub scanning direction A of the respective line-heads, while ink is jetted from the transparent ink line-head on the recording area.

Thereafter, when a series of the above described operation has been performed, image recording on the above described recording area is completed.

As described above, in the inkjet recording apparatus in the present embodiment, the white ink recording head 31, the process-color ink recording heads 32 to 39, and the transparent ink recording head 40 are line-heads disposed orthogonally to the conveying direction on the recording medium R. While the apparatus is a line print type inkjet recording apparatus as described above, the apparatus jets ink from the white ink line-head 31, then, at least from one process-color ink line-head of the respective process-color ink line-heads 32 to 39, and then from the transparent ink line-head 40. Accordingly, the white ink jetted first can prevent transmission of light, thereby the image can clearly stand out, and image recording can be performed on the transparent or translucent recording medium R.

Further, the transparent ink jetted last makes the amount of ink on the surface of the recording medium R uniform to prevent making the surface formed on the recording medium rough, by which it is possible to record a highly precise image with a uniform feeling of gloss without performing a special post-processing.

Further, the white ink recording head 31, the respective process-color ink recording heads 32 to 39, and the transparent ink recording head 40 are line-heads. With a simple structure with consideration of disposition of the line-heads, the white ink can prevent transmission of light, and the transparent ink can prevent the surface of the recording medium R from becoming rough, by which it is possible to miniaturize the inkjet recording apparatus 1 and reduce the manufacturing cost.

In the first and second embodiments, the white ink recording heads 6, the process-color ink recording heads 6, and the transparent ink recording heads 6 can jet ink in conditions different from each other, wherein the white ink recording heads 6 and the process-color ink recording heads 6 can jet inks heated at temperatures different from each other. In this case, pitch P may be larger than at least one of pitches P1, P2, and P3.

Figure 5:
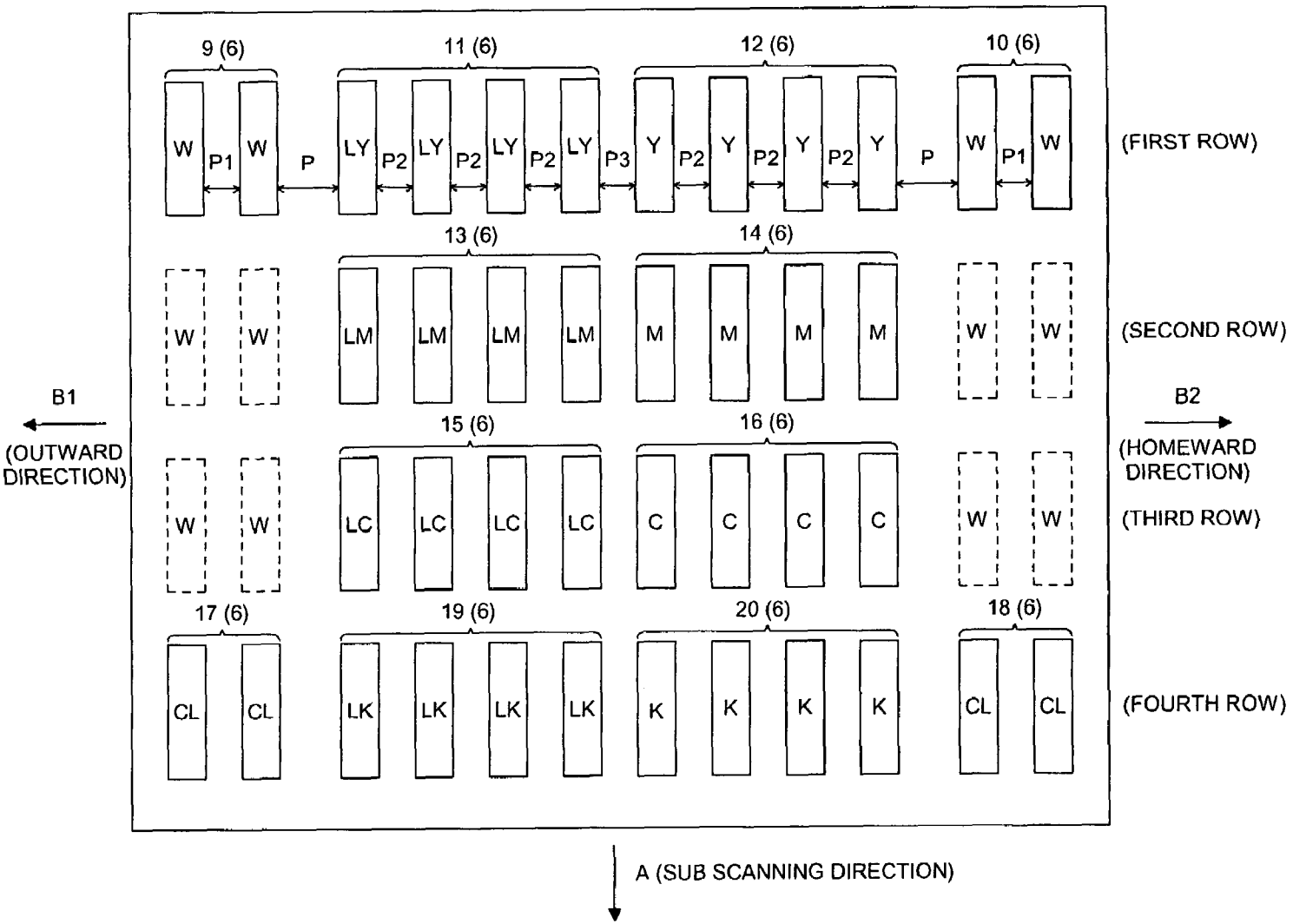
FIG. 5 is a plane view showing a modified example of disposition relationship between the groups of the white ink recording heads, the groups of the respective process-color ink recording heads, and the groups of the transparent ink recording heads in the first embodiment.
Figure 6:
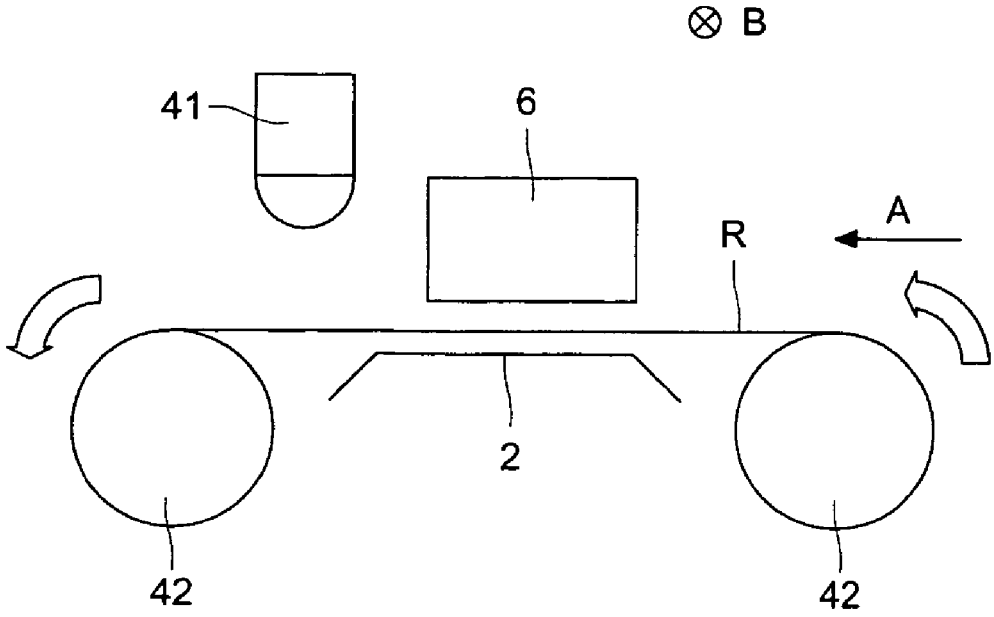
FIG. 6 is a schematic diagram showing a first modified example of an inkjet recording apparatus in accordance with the invention.

For example, the pitches shown in FIG. 2 may be changed to those shown in FIG. 5. In FIG. 5, pitch P1 is shorter than pitch P, and accordingly, the neighboring white ink recording heads are close to each other. Therefore, it is possible to make the heating temperature of white ink in the white ink recording heads 6 uniform. Further, in FIG. 5, pitch P2 and pitch P3 are shorter than pitch P, and accordingly, the respective ink recording heads of the same process-color inks and also the respective process-color ink recording heads are further closer to each other. Therefore, it is possible to make the heating temperature of the process-color inks uniform. Still further, with regard to the white ink recording heads 6 and the process-color ink recording heads 6, the heating temperatures at portions which affect ink jetting can be made uniform. Therefore, one group of recording heads 6 is not affected by the difference in temperature between the one group and another group. Thus, ink can be jetted at optimum heating temperatures from the respective recording heads 6.

Also in the example shown in FIG. 3, in case of jetting inks from the white ink recording heads 6 and the process-color ink recording heads 6 at ink heating temperatures different from each other, pitch P may be set larger than pitch P3. In this case also, ink can be jetted at optimum heating temperatures from the respective recording heads 6.

In the first to third embodiments, inks in the respective colors are jetted from the respective process-color ink recording heads. However, it is not always necessary to jet inks from all the process-color ink recording heads, and it is also allowed if ink is jetted from at least one process-color ink recording head of the respective process-color ink recording heads. Still further, regarding recording heads 6, in the first and second embodiments, four recording heads 6 gather to form one group, as shown in FIGS. 2 and 3. However, the numbers of recording heads of respective groups of recording heads 6 are not necessarily four, and can be changed as necessary. Also, a group may be formed only by a single recording head instead of a group of plural recording heads.

Yet further, although white is applied to the background color in the first to third embodiments, background color is not limited to white. For example, instead of the white ink recording heads 9, 10, 21, 31 for jetting white ink, recording heads which jet ink other than white ink may be arranged to apply a special color other than white to the background.

Herein, a special color is a color that is not one of the above mentioned process-colors or a combination of process colors. For example, it can be gold, silver, blue, green, red, russet, ocher, carmine, which cannot be expressed by each process color, or by combination of respective process colors.

Further, while in the first to third embodiments, the white ink, the respective process-color inks, and the transparent ink are UV-curable inks, a special color ink also may be a UV-curable ink. In a case where the white ink, the respective process-color inks, the transparent ink, and the special ink are UV-curable inks, a UV light emitting device 41 may be provided on the downstream side of the platen 2 in the sub scanning direction A so that the UV light emitting device 41 emits UV light to ink which has been jetted from recording heads 6 and landed on the recording medium R, in a state where a recording medium R is absorbed and held by the platen 2. Thus, the ink jetted onto the recording medium R can be instantly cured.

Figure 7:
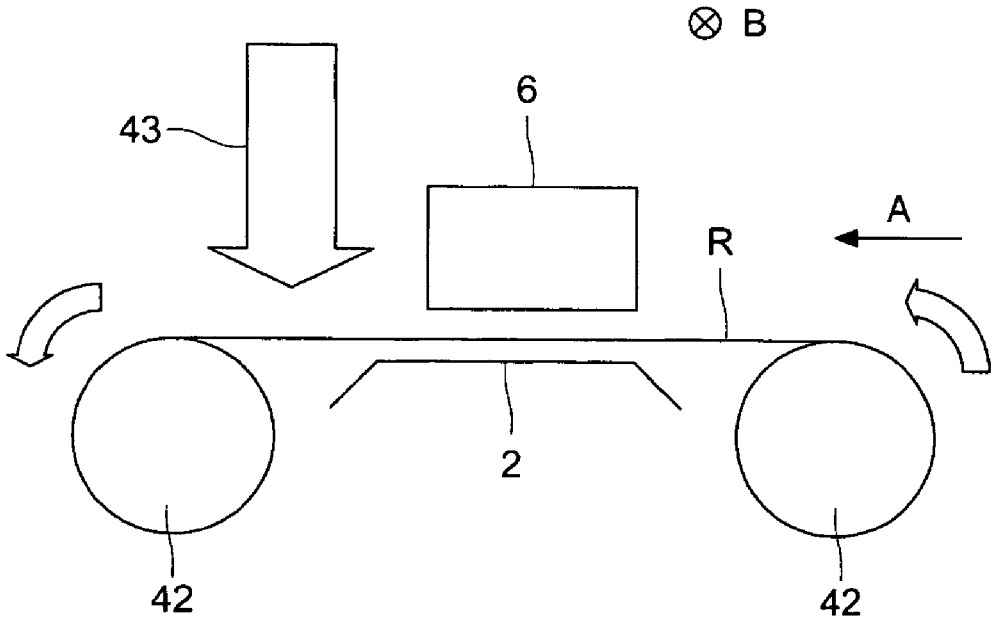
FIG. 7 is a schematic diagram showing a second modified example of an inkjet recording apparatus in accordance with the invention.

Still further, in a case that at least one of water-based ink, oil-based ink, solvent ink, and solid ink is used as the white ink, the respective process-color ink, the transparent ink, and the special ink, a fixing mechanism 43 may be provided, as shown in FIG. 7, on the downstream side of the platen 2 in the sub scanning direction A, and thus various actions may be performed by the fixing mechanism 43 on ink which has been jetted from recording heads 6 and landed on the recording medium R, in a state where a recording medium R is absorbed and held by the platen 2.

Various actions by the fixing mechanism 43 are, for example, infrared radiation, heating by a heater, and drying with warm air, by which ink landed on the recording medium R can be instantly fixed to the recording medium R.

What is claimed is:

1. An ink jet recording apparatus, comprising:

a conveying device for conveying a recording medium to a recording area where ink is jetted; and a plurality of recording heads for jetting ink onto the recording medium, wherein the plurality of recording heads includes a background-color ink recording head for jetting a background-color ink, process-color ink recording heads for jetting process-color inks in respective process colors, and a transparent ink recording head for jetting a transparent ink, and wherein the background-color ink recording head is disposed on a most upstream side in a conveying direction of the recording medium, and the transparent ink recording head is disposed on a most downstream side in the conveying direction of the recording medium so that transparent ink is jetted onto the recording medium after said background-color ink and said process-color ink.

2. The inkjet recording apparatus of claim 1, comprising a carriage that scans in a direction orthogonal to the conveying direction of the recording medium, wherein the background-color ink recording head, the process-color ink recording heads, and the transparent ink recording head are mounted on the carriage.

3. The inkjet recording apparatus of claim 2, wherein the background-color ink recording head is disposed at a most upstream end or both ends of a row of recording heads disposed in the scanning direction, and the transparent ink recording head is disposed at a most downstream end or both ends of a row of recording heads disposed in the scanning direction.

4. The inkjet recording apparatus of claim 1, wherein the background-color ink recording head, the respective process-color ink recording heads, and the transparent ink recording head are line heads disposed with a longitudinal direction of each recording head orthogonal to the conveying direction of the recording medium.

5. The inkjet recording apparatus of claim 1, wherein, the inks to be jetted from the respective recording heads, the heads being the background-color ink recording head, the process-color ink recording heads, and the transparent ink recording head, are jetted as ink droplets, and wherein a jetting amount per droplet of the ink jetted from at least either the background-color ink recording head or the transparent ink recording head is larger than a jetting amount per droplet of the ink jetted from each of the process-color ink recording heads.

6. The inkjet recording apparatus of claim 1, wherein the background-color ink, the respective process-color inks, and the transparent ink are UV curable inks.

7. The inkjet recording apparatus of claim 1, comprising a UV light emitter.

8. The inkjet recording apparatus of claim 1, wherein the recording medium on which to record an image with the background-color ink, the respective process-color inks, and the transparent ink is a transparent or translucent resin film.

9. An inkjet recording method, comprising the steps of:

a recording medium conveying step of conveying a recording medium to a recording area where ink is jetted;

an ink jetting step of jetting a background-color ink from a background-color ink recording head first and a transparent ink from a transparent ink recording head last at each pixel on a recording surface of the recording medium to form a bottom layer of the background-color ink and a top layer of the transparent ink on the recording surface.

10. The inkjet recording method of claim 9, wherein the ink jetting step further includes jetting process-color ink, and wherein, on a pixel where at least one of a plurality of process-color inks in respective process colors is jetted, the process-color ink/inks are jetted during a time between jetting the background-color ink and jetting the transparent ink.

11. The inkjet recording method of claim 9, wherein a jetting amount per droplet of the ink jetted from at least either the background-color ink recording head or the transparent ink recording head is set to be larger than a jetting amount per droplet of the ink jetted from each of the process-color ink recording heads.

12. The inkjet recording method of claim 9, wherein UV curable inks are employed as the background-color ink, the respective process-color inks, and the transparent ink, the method further comprising the step of:

a UV light emitting step of emitting UV light onto ink having landed on the recording surface to cure the ink.

* * * * *